United States Patent [19]

Mumford et al.

[11] Patent Number: 4,475,344

[45] Date of Patent: Oct. 9, 1984

[54] LOW SMOKE COMBUSTOR FOR LAND BASED COMBUSTION TURBINES

[75] Inventors: Stephen E. Mumford; Edward W. Tobery, both of West Chester, Pa.

[73] Assignee: Westinghouse Electric Corp., Pittsburgh, Pa.

[21] Appl. No.: 349,125

[22] Filed: Feb. 16, 1982

[51] Int. Cl.[3] ..... F02C 3/14

[52] U.S. Cl. ..... 60/757; 60/758

[58] Field of Search ..... 60/39.32, 752, 755, 60/757, 758

[56] References Cited

U.S. PATENT DOCUMENTS

| | | | |
|---|---|---|---|
| 2,525,206 | 10/1950 | Clarke | 60/752 |
| 2,547,619 | 4/1951 | Bockland | 60/39.32 |
| 2,595,999 | 5/1952 | Way et al. | 60/752 |
| 2,664,702 | 1/1954 | Lloyd et al. | 60/752 |
| 3,064,424 | 11/1962 | Tomlinson | 60/757 |
| 3,138,930 | 1/1964 | Waters et al. | 60/757 |
| 3,938,323 | 2/1976 | Quigg et al. | 60/752 |

FOREIGN PATENT DOCUMENTS

| | | | |
|---|---|---|---|
| 2414581 | 10/1974 | Fed. Rep. of Germany | 60/39.32 |
| 762596 | 11/1956 | United Kingdom . | |

*Primary Examiner*—Louis J. Casaregola
*Attorney, Agent, or Firm*—E. F. Possessky

[57] ABSTRACT

An improved combustor basket for a land-based combustion turbine comprises a plurality of ring segments joined in telescoping fashion to form a constant diameter basket, the downstream end of each ring segment having an extended lip for improved film cooling of the interior surface of the ring segments, a combustor dome adjoining the upstream end of the combustor basket and having an interior splash plate directing a cooling air film along the interior surface of the dome wall, fuel injecting means, and oval-shaped scoops for directing the flow of compressed air into the combustion zone. Each ring segment, excluding the first, comprises an upstream cylindrical section, a conical section, and a downstream cylindrical section, which geometrical arrangement permits construction of a constant diameter combustor basket. The combined improvements of the present combustor basket result in more efficient and complete combustion, which results in the production of less smoke.

9 Claims, 2 Drawing Figures

LOW SMOKE COMBUSTOR FOR LAND BASED COMBUSTION TURBINES

BACKGROUND OF THE INVENTION

The present invention relates to land-based combustion turbines used for generating electric power and for other industrial purposes and more particularly, to combustor baskets employed therein.

In general terms, the typical prior art combustion turbine comprises three sections: a compressor section, a combustor section, and a turbine section. Air drawn into the compressor section is compressed, increasing its temperature and density. The compressed air from the compressor section flows through the combustor section where the temperature of the air mass is further increased. From the combustor section the hot pressurized gases flow into the turbine section where the energy of the expanding gases is transformed into rotational motion of a turbine rotor.

A typical combustor section comprises a plurality of combustor baskets arranged in an annular array about the circumference of the combustion turbine. In conventional combustor technology pressurized gases flowing from a compressor section are heated by a diffusion flame in the combustor basket before passing to the turbine section. In the diffusion flame technique, fuel is sprayed into the upstream end of the combustor by a nozzle. Combustion occurs in a primary combustion zone downstream of the nozzle. Incomplete combustion, caused by incomplete mixing of the fuel and compressed air, results in the production of smoke and other undesirable pollutants.

Increasing environmental awareness has resulted in more stringent emission standards for combustion turbines. Voluntary efforts to improve combustion turbines as well as mandatory requirements of compliance with emission standards have made it desirable to develop combustion turbines which generate more power more efficiently with less environmental impact. To this end, it has been desirable to design an improved combustor capable of heating compressed gases to increased temperature levels while producing reduced levels of smoke.

SUMMARY OF THE INVENTION

Accordingly, a combustion turbine combustor basket comprises a plurality of ring segments adjoined to form a generally cylindrical, telescoping enclosure of substantially constant diameter, a generally cone-shaped dome adjoined to and enclosing an upstream end of the enclosure, means for injecting fuel through an opening in the dome, and a plurality of generally oval-shaped scoops in the upstream end of the basket for injecting compressed air into a combustion zone. The constant diameter basket provides a larger volume combustion zone for receiving increased fuel and air flow. The oval scoops deliver air flow with greater penetration into the fuel stream, achieving improved heating efficiency and more complete combustion, which results in the production of less smoke.

DESCRIPTION OF THE PREFERRED EMBODIMENT

Figure 1:
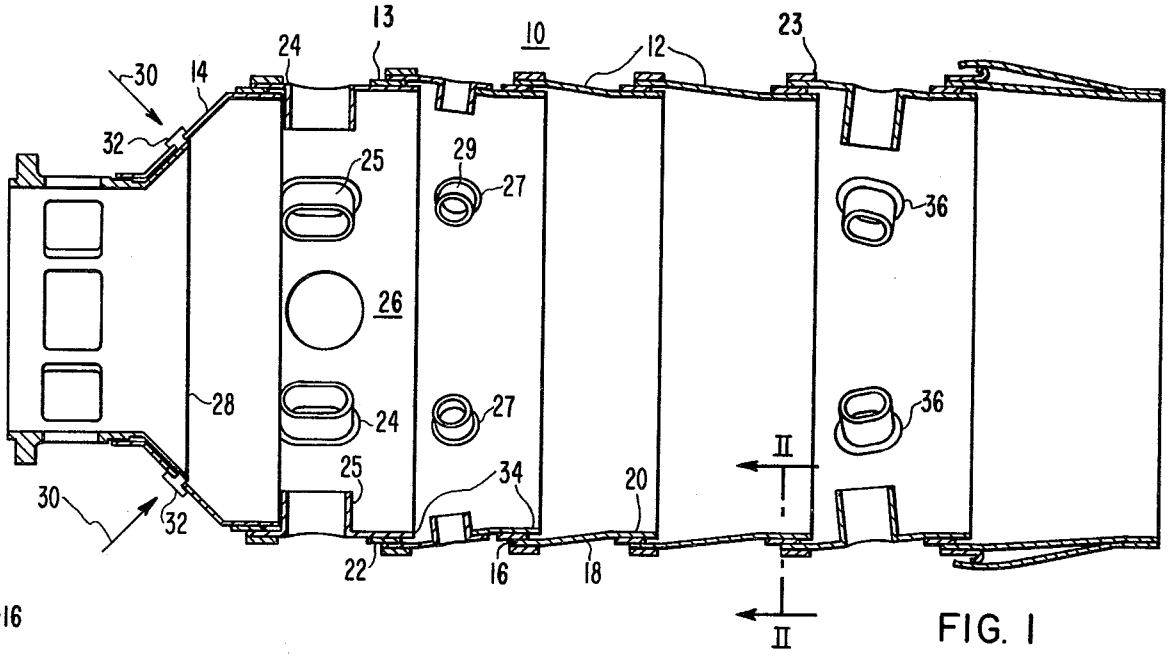
FIG. 1 shows in elevation a combustor basket structured according to the principles of the invention.

More particularly, there is shown in FIG. 1 a combustor basket 10 comprised of a plurality of ring segments 12 and a combustor dome 14. Each ring segment 12, excluding the first ring segment 13, comprises an upstream cylindrical section 16, a conical section 18, and a downstream cylindrical section 20. The first ring segment 13 comprises a single cylindrical section. The ring segments 12 are preferably comprised of stretch-formed metal, but may be formed by welding the three sections 16, 18, 20 together. The plurality of ring segments 12, each having the three-section geometry, and the first ring segment 13 combine to form an enclosure for the combustor basket 10 having a substantially constant diameter, to be contrasted with prior art "telescoping" combustor baskets, which generally increase in diameter from the upstream to the downstream end. Whereas a prior art combustor basket might increase in diameter from nine inches at the upstream end to twelve inches at the downstream end, a combustor basket structured according to the principles of the present invention might have a cylindrical enclosure with a constant diameter of approximately 12.5 inches.

Figure 2:
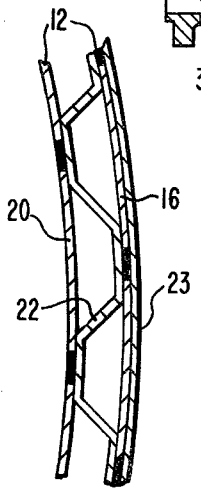
FIG. 2 shows a sectional view of two adjoining ring segments shown in FIG. 1.

The upstream end 16 of each ring segment 12 overlaps in telescoping fashion the downstream end 20 of the adjacent upstream ring segment 12. The overlapping portions of the adjoining ring segments 12 are separated by a corrugated spacer band 22. FIG. 2 depicts a portion of the combustor basket 10 in cross-section, showing the overlapping ring segments 12 and the spacer band 22 therebetween. The ring segments 12, 13 are attached to the spacer band 22 by appropriate means, such as spot welding. The overlapping portion of the outer ring segments 12, 13 is preferably slotted to prevent spot weld failure due to high thermal stresses.

Because the overlapping portion, or upstream cylindrical section 16, of each ring segment 12, 13 is slotted, a slot cover ring 23 is provided to prevent air flow from entering the combustor basket 10 through the slots in the ring segments 12, 13. Such air flow tends to disrupt the primary cooling air flow which passes between the ring segments 12, 13 to form a cooling air film along the interior wall of the combustor basket 10. The slot cover ring 23 is preferably slotted at approximately the same intervals as the ring segments 12, 13. The slots in the slot cover ring 23 are oriented so as not to be aligned with the slots in the ring segments 12, 13. The slot cover ring 23, which is preferably spot welded to the ring segments 12, 13, thereby enables the ring segments to be slotted for thermal expansion without detrimentally affecting cooling efficiency.

The corrugated spacer band 22 provides an annular space of approximately 0.086 inch width between the adjoining ring segments 12, permitting the entry of cooling air to film cool the ring segments 12, 13 immediately downstream. Effective film cooling diminishes impingement of hot gases on the interior surface of the ring segment. The width of the space between the adjoining ring segments 12, 13 may be adjusted at the downstream end of the combustor basket 10, preferably to 0.056 inch, by appropriate construction of the spacer band 22 so as to reduce the flow of cooling air in those portions of the combustor basket 10 where less cooling air is required.

The upstream end of the combustor basket 10 is provided with six oval scoops 24, each having an interior lip 25, for directing the flow of compressed air into a combustion zone 26, where the compressed air mixes with the fuel for combustion. The oval shape of the scoops 24, oriented with the long dimension of the oval parallel to the axis of the combustor basket 10, improves the penetration of the air flow into the fuel gas stream flowing from the nozzle (not shown). Better penetration insures more complete mixing the compressed air with the fuel and thereby achieves more complete combustion with less smoke production.

The combustor basket 10 is also provided with a second ring of six scoops 27 having lips 29 angled slightly upstream. The scoops 27 are positioned downstream of the oval scoops 24 so as to promote mixing and complete combustion. A third ring of scoops 36, preferably oval-shaped, are located in the downstream end of the combustor basket 10 to provide compressed air to dilute the temperature of the hot gas stream so as to prevent damage to turbine parts. The second and third rings of scoops 27, 36 are positioned in the conical section 18 of the respective ring segments 12.

The volume of the combustion zone 26 is important in controlling the combustion reaction. Where the volume is too small, some combustion may occur downstream, outside the combustion zone 26. Where the volume is too large, the operational stability of the combustor suffers, for example, the combustor may be susceptible to blowout under low load conditions. A combustion zone having a volume which is too large is also susceptible to poor mixing of the fuel and air, leading to less complete combustion, and has more inner surface area which must be cooled. As pointed out above, the geometry of the ring segments 12 permits the combustor basket 10 to be constructed with a substantially constant diameter. The combustor basket 10 is preferably constructed with a diameter of approximately 12.5 inches, resulting in a combustion zone 26 of substantially greater volume than the corresponding combustion zone of a comparable prior art combustor basket.

The combustor basket 10, because of its higher volume combustion zone 26, may operate with a greater flow of compressed air into the combustion zone 26 than would a comparable prior art combustor basket. Fuel flow into the combustion zone 26 may also be increased, but because of the larger volume of the combustion zone 26 and the greater flow of compressed air into the combustion zone 26, the density of fuel in the combustion zone 26 may be less than that of a comparable prior art combustor basket. The leaner fuel mixture is more effectively mixed by the flow of compressed air into the combustion zone 26, thereby giving rise to more complete combustion and decreased production of pollutants such as smoke. The oval shape of the scoops 24 delivering the compressed air to the combustion zone 26 improves penetration of the air flow into the fuel stream, resulting in improved fuel-air mixing and also decreasing smoke production by providing for more complete combustion. Although the flow of gases through the combustion zone 26 is increased as a result of the larger volume of the combustion zone 26, the velocity of gases passing through the combustion zone 26 may be decreased, allowing more time for complete combustion (smoke burnout).

Increased levels of fuel flow and complete combustion within the combustion zone 26 expose the interior walls of the combustor basket 10 to reaction temperatures higher than those ordinarily experienced by typical prior art combustor baskets. The combustor basket 10 includes features for improving the effectiveness of the film cooling arrangement utilized to cool the interior combustor basket walls.

The combustor basket 10 includes a generally conical splash plate 28 sealingly affixed to the upstream, interior end of the combustor dome 14 and spaced apart from the dome 14 to form an annular space, open in the downstream direction, between the dome 14 and the splash plate 28. Cooling air 30 enters the combustor dome 14 through a plurality of cooling air ports 32 whereupon the splash plate 28 directs a film of cooling air along the exposed interior surface of the combustor dome 14. The film of cooling air reduces impingement of hot gases on the interior surface of the combustor dome wall and thereby maintains the wall at a temperature substantially reduced from the reaction temperature. The splash plate 28 effectively reduces the length of combustor dome wall which must be film cooled. The splash plate 28 also provides a more effective means for directing the cooling air film than is found in typical prior art combustors.

An efficient arrangement for film cooling the interior walls of the ring segments 12, 13 is provided by an extended inner lip 34 on the downstream end of each ring segment 12, 13. The extended lip 34 comprises an extension of the cylindrical section 20 of each ring segment 12, 13 beyond the downstream end of the spacer band 22. The benefits of the extended lip 34 are threefold. First, because the length of the annular coolant passageway is effectively increased by the extended lip 34, the length of interior wall which must be cooled is decreased. Second, because the coolant passageway now extends beyond the spacer band 22, the detrimental effect of turbulence induced in the coolant film by the corrugated spacer band 22 is reduced. Finally, because the width of the annular coolant passageway beyond the spacer band is increased by the amount of the thickness of the spacer band 22 (approximately 0.032 inch), the cooling effectiveness of the film of cooling air emitted from the passageway is improved by its increased thickness.

Hence, the combustor basket 10, by an appropriate combination of features, achieves improved compressed air heating efficiency with a concurrent reduction in the level of smoke production. The larger volume combustion zone 26 permits increased fuel flow while decreasing the fuel concentration within the combustion zone 26, resulting in improved fuel-air mixing. The larger volume combustion zone 26 also permits lower velocity gas flow in the combustion zone 26. The improved mixing and the slower gas velocities give rise to more efficient combustion and reduced levels of smoke production.

The oval shape of the scoops 24 improves the penetration of compressed air flow into the combustion zone 26, further improving fuel-air mixing and thereby reducing smoke production.

The extended lip on the ring segments 12, 13 and the splash plate 28 inside the combustor dome 14 provide effective cooling arrangements which compensate for the higher temperatures generated by a combustion reaction maintained to completion in the upstream end of the combustor basket 10.

The slot ring cover 23 insulates the slotted ring segments 12, 13 from undesirable air flow through the slots, permitting effective film cooling of the combustor basket while enabling operation at higher temperatures which require the ring segments to be slotted for thermal expansion.

What is claimed is:

1. A combustor basket for heating compressor discharge gases to drive a turbine, comprising:

a plurality of ring segments, each of said ring segments having an inner surface and an outer surface, adjoined in telescoping fashion to form a generally cylindrical portion of said basket, said cylindrical portion having an upstream end, a downstream end, and a longitudinal axis, and being of substantially constant diameter;

a combustor dome, having an upstream end and a downstream end, adjoining the upstream end of said cylindrical portion of said basket, said dome being generally conical with diameter increasing in the downstream direction;

means adjoining said dome for injecting fuel into a combustion zone in the upstream end of said cylindrical portion of said basket; and a plurality of generally oval-shaped scoops in a ring segment in the upstream end of said cylindrical portion for directing a flow of compressed air into said combustion zone, each of said scoops having a long dimension and a short dimension with the long dimension generally parallel to the longitudinal axis of said cylindrical portion;

and said cylindrical portion of said basket further having a second plurality of scoops generally circular in shape for directing an additional flow of compressed air into said combustion zone in a slightly upstream direction.

2. A combustor basket according to claim 1 wherein at least two of said ring segments comprise an upstream cylindrical section, a conical section having a diameter decreasing in the downstream direction, and a downstream cylindrical section, whereby said upstream cylindrical section of one of said ring segments overlaps said downstream cylindrical section of another of said ring segments positioned adjacent to and upstream of said first ring segment.

3. A combustor basket according to claim 2 wherein each pair of said adjoining ring segments are spaced apart by and affixed to a corrugated spacer band, which directs a film of cooling air along the inner surface of said ring segment positioned downstream of said spacer band.

4. A combustor basket according to claim 3 wherein said adjoining ring segments are spot welded to said spacer band.

5. A combustor basket according to claim 3 wherein said downstream cylindrical section of each of said ring segments extends beyond said spacer band to form an extended lip, whereby the effectiveness of the film cooling of said adjacent ring segment is improved.

6. A combustor basket according to claim 5 wherein said dome includes a generally conical splash plate sealingly affixed to an interior surface of said upstream end of said dome and spaced apart from said dome to form an annular space, open in the downstream direction, between said dome and said splash plate; and a plurality of cooling air ports through said dome opposing said splash plate, whereby cooling air enters from the exterior of said combustor basket into the annular space between said dome and said splash plate and is directed as a film along the exposed interior surface of said dome.

7. A combustor basket according to claim 5 wherein said cylindrical portion of said basket includes six oval-shaped scoops.

8. A combustor basket according to claim 5 wherein said cylindrical portion of said basket further comprises a third plurality of scoops in the downstream end of said cylindrical portion for directing a flow of compressed air to dilute hot gases exiting said combustor basket.

9. A combustor basket according to claim 8 wherein said third plurality of scoops are generally oval-shaped and are arranged to direct compressed air slightly upstream.

* * * * *